US010792660B1

(12) United States Patent
Ndao et al.

(10) Patent No.: US 10,792,660 B1
(45) Date of Patent: Oct. 6, 2020

(54) LEIDENFROST DROPLET MICROFLUIDICS

(71) Applicant: NuTech Ventures, Inc., Lincoln, NE (US)

(72) Inventors: Sidy Ndao, Lincoln, NE (US); George Gogos, Lincoln, NE (US); Dennis Alexander, Lincoln, NE (US); Troy Anderson, Omaha, NE (US); Craig Zuhlke, Lincoln, NE (US)

(73) Assignee: NUtech Ventures, Lincoln, NE (US)

( * ) Notice: Subject to any disclaimer, the term of this patent is extended or adjusted under 35 U.S.C. 154(b) by 1158 days.

(21) Appl. No.: 14/595,487

(22) Filed: Jan. 13, 2015

Related U.S. Application Data

(60) Provisional application No. 61/926,436, filed on Jan. 13, 2014.

(51) Int. Cl.
*B01L 3/00* (2006.01)

(52) U.S. Cl.
CPC ... *B01L 3/502792* (2013.01); *B01L 3/502746* (2013.01); *B01L 2300/1805* (2013.01); *B01L 2400/04* (2013.01)

(58) Field of Classification Search
CPC ..... B01L 3/502792; B01L 3/502746; B01L 3/5027; B01L 3/502; B01L 3/50; B01L 2300/1805; B01L 2300/18; B01L 2400/04; B01L 2400/00
USPC ..... 422/502, 500, 50
See application file for complete search history.

(56) References Cited

U.S. PATENT DOCUMENTS

2006/0028908 A1* 2/2006 Suriadi ..... B01F 13/0079 366/146
2007/0059213 A1* 3/2007 Aizenberg ..... B01F 13/0071 422/400
2013/0032646 A1* 2/2013 Dhiman ..... B05B 1/26 239/461
2018/0071696 A1* 3/2018 Samarao ..... B01F 5/00

OTHER PUBLICATIONS

Ok J. T., Lopez-Oña E., Nikotopolos D. E., Wong H. & Park S., Propulsion of droplets on micro- and sub-micron ratchet surfaces in the Leidenfrost temperature regime., Microfluid Nanofluid 10, 1045 (2011). (Year: 2011).*
Xu X. & Qian T., Thermal singularity and droplet motion in one-component fluids on solid substrates with thermal gradients., Phys. Rev. E. 85, 061603 (2012). (Year: 2012).*
(Continued)

*Primary Examiner* — Christine T Mui
(74) *Attorney, Agent, or Firm* — Leydig, Voit & Mayer, Ltd.

(57) ABSTRACT

Systems and methods are described for propelling a liquid droplet in a Leidenfrost state. A microfluidic device embodiment includes, but is not limited to, a solid structure having a patterned surface, the patterned surface including at least a first patterned region having a first Leidenfrost temperature with respect to a fluid material and a second patterned region having a second Leidenfrost temperature with respect to the fluid, the first patterned region adjacent to the second patterned region, the first patterned region defining a path over which a droplet of the fluid is configured to travel in a Leidenfrost state.

20 Claims, 9 Drawing Sheets

(56) References Cited

OTHER PUBLICATIONS

Kruse, Corey et al., Controlling the Leidenfrost Temperature Through Laser-Assisted Surface Micro/Nano Texturing , Proceeding of the ASME 2013 Heat Transfer Summer Conference, HT2013, Jul. 14-19, 2013, Minneapolis, MN, USA, 1-7. (Year: 2013).*
Dupeux, Guillaume et al, Trapping Leidenfrost Drops with Crenelations, Physical Review Letter, 2011, 201, 114503-1-114503-4. (Year: 2011).*
Shabani, Roxana et al, Droplets on liquid surfaces: Dual equilibrium states and their energy barrier, Appl. Phys. Lett. 2013, 102, 184101. (Year: 2013).*
Agapov, R.L., Boreyko, J.B., Briggs, D.P. et al. (2014), "Length scale of Leidenfrost ratchet switches droplet directionality. Nanoscale" doi: 10.1039/c4nr02362e.
Bradfield, W. (1966), "Liquid-solid contact in stable film boiling", Ind Eng Chem Fundam 5:200-204.
Brochard, F. (1989), "Motions of droplets on solid surfaces induced by chemical or thermal gradients", Langmuir 5:432-438.
Brzoska, J., Brochard-Wyart, F., Rondelez, F. (1993), "Motions of droplets on hydrophobic model surfaces induced by thermal gradients", Langmuir 9:2220-2224.
Chaudhury, M., Whitesides, G. (1992), "How to make water run uphill", Science (80- ) 256:1539-1541. (Abstract).
Darhuber, A.A., Valentino, J.P., Davis, J.M. et al. (2003), "Microfluidic actuation by modulation of surface stresses", Appl Phys Lett 82:657. doi: 10.1063/1.1537512.
Dos Santos, F., Ondarcuhu, T. (1995), "Free-running droplets", Phys Rev Lett 75:2972. (Abstract).
Dupeux, G., Le Merrer, M., Lagubeaum G. et al. (2011), "Viscous mechanism for Leidenfrost propulsion on a ratchet", EPL Europhysics Lett 96:58001. doi: 10.1209/0295-5075/96/58001.
Grounds, A., Still, R., Takashina, K. (2012), "Enhanced droplet control by transition boiling", Sci Rep 2:720. doi: 10.1038/srep00720.
Hashmi, A., Xu, Y., Coder, B. et al. (2012), "Leidenfrost levitation: beyond droplets", Sci Rep 2:797. doi: 10.1038/srep00797.
Hwang, T.Y., Guo, C. (2011), "Polarization and angular effects of femtosecond laser-induced nanostructure-covered large scale waves on metals", J Appl Phys. doi: 10.1063/1.3646330.
John, K., Bar, M., Thiele, U. (2005), "Self-propelled running droplets on solid substrates driven by chemical reactions", Eur Phys J E Soft Matter 18:183-99. doi: 10.1140/epje/i2005-10039-1.
Kim, H., Truong, B., Buongiorno, J., Hu, L-W. (2011), "On the effect of surface roughness height, wettability, and nanoporosity on Leidenfrost phenomena", Appl Phys Lett 98:083121. doi: 10.1063/1.3560060.
Kruse, C., Anderson, T., Wilson, C. et al. (2013), "Extraordinary shifts of the Leidenfrost temperature from multiscale micro/nanostructured surfaces", Langmuir 29:9798-806. doi: 10.1021/la401936w.
Lagubeau, G/, Le Merrer, M., Clanet, C, Quéré D (2011), "Leidenfrost on a ratchet", Nat Phys 7:395-398. doi: 10.1038/nphys1925.
Linke, H., Alemán, B., Melling, L. et al. (2006), "Self-Propelled Leidenfrost Droplets", Phys Rev Lett 96:2-5. doi: 10.1103/PhysRevLett.96.154502.
Marin, A.G., Cerro, D.A. del (2012), "Capillary droplets on Leidenfrost micro-ratchets", Phys Fluids 24:122001.
Nayak, B.K., Gupta, M.C., Kolasinski, K.W. (2007), "Formation of nano-textured conical microstructures in titanium metal surface by femtosecond laser irradiation", Appl Phys A 90:399-402. doi: 10.1007/s00339-007-4349-2.
Ok, J.T., Lopez-Oña, E., Nikitopoulos, D.E., et al. (2010), "Propulsion of droplets on micro- and sub-micron ratchet surfaces in the Leidenfrost temperature regime", Microfluid Nanofluidics 10:1045-1054. doi: 10.1007/s10404-010-0733-x.
Piroird, K., Clanet, C., Quéré, D. (2012), "Magnetic control of Leidenfrost drops", Phys Rev E 85:10-13. doi: 10.1103/PhysRevE.85.056311.
Tsibidis, G.D., Stratakis, E., Loukakos, P.A., Fotakis, C. (2013), "Controlled ultrashort-pulse laser-induced ripple formation on semiconductors", Appl Phys A 114:57-68.
Vorobyev, A.Y., Guo C. (2013), "Direct femtosecond laser surface nano/microstructuring and its applications", Laser Photon Rev 7:385-407. doi: 10.1002/lpor.201200017.
Zuhlke, C.A., Anderson T.P., Alexander, D.R. (2013) "Comparison of the structural and chemical composition of two unique micro/nanostructures produced by femtosecond laser interactions on nickel", Appl Phys Lett 103:121603. doi: 10.1063/1.4821452.
Zuhlke et al., "Fundamentals of layered nanoparticle covered pyramidal structures formed on nickel during femtosecond laser surface interactions," Applied Surface Science 283 (2013), 648-653.
Zuhlke, C.A. et al. (2010), "Self assembled nanoparticle aggregates from line focused femtosecond laser ablation", Optics Express, vol. 18, No. 5, 4329-4339.
Zuhlke, C.A. et al. (2014), "A Fundamental Understanding of the Dependence of the Laser-Induced Breakdown Spectroscopy (LIBS) Signal Strength on the Complex Focusing Dynamics of Femtosecond Laser Pulses on Either Side of the Focus", Applied Spectroscopy, vol. 68. No. 9, 1021-1029.
Zhang, S., Gogos, G., "Film evaporation of a spherical droplet over a hot surface: fluid mechanics and heat! mass transfer analysis", J. Fluid Mech. 1991, 222, 543-563. (Abstract).
Biance, A, Clanet, C., Quere, D., "Leidenfrost drops", Phys. Fluids 2003, 15, 1632-1637.
Burton, J., Sharpe, A., van der Veen, R., Franco, A., Nagel, S., "Geometry of the vapor layer under a Leidenfrost drop", Phys. Rev. Lett. 2012, 109, 074301.
Vakarelski, I., Patankar, N., Marston, J., Chan, D., Thoroddsen, S., "Stabilization of Leidenfrost vapour layer by textured superhydrophobic surfaces", Nature 2012, 489 (7415), 274-277.
Vakarelski, I., Marston, J., Chan, D., Thoroddsen, S., "Drag reduction by Leidenfrost vapor layers", Phys. Rev. Lett. 2011, 106, 214501.
Carey, V. P., "Liquid-vapor phase-change phenomena", Taylor and Francis, 1992. (Abstract).
Bernardin, J., Mudawar, I., "The Leidenfrost point: experimental study and assessment of existing models", Transactions-American Society of Mechanical Engineers Journal of Heat Transfer 1999, 121, 894-903.
Tamura, Z., Tanasawa, Y., "Evaporation and combustion of a drop contacting with a hot surface", Symposium (International) on Combustion 1958, 7, 509-522.
Patel, B. M., Bell, K J., "The Leidenfrost phenomenon for extended liquid masses", Doctoral dissertation, Oklahoma State University, 1965. (Abstract).
Emmerson, G., "The effect of pressure and surface material on the leidenfrost point of discrete drops of water", Int. J. Heat Mass Transfer 1975, 18 (3), 381-386. (Abstract).
Xiong, T., Yuen, M., "Evaporation of a liquid droplet on a hot plate", Int. J. Heat Mass Transfer 1991, 34 (7), 1881-1894. (Abstract).
Hughes, F., "The evaporation of drops from super-heated nano-engineered surfaces", Doctoral dissertation, Massachusetts Institute of Technology, 2009.
Takata, Y., Hidaka, S., Yamashita, A., Yamamoto, H., "Evaporation of water drop on a plasma-irradiated hydrophilic surface", International Journal of Heat and Fluid Flow 2004, 25 (2), 320-328.
Munoz, R., Beving, D., Yan, Y., "Hydrophilic zeolite coatings for improved heat transfer", Ind. Eng. Chem. Res. 2005, 44, 4310-4315.
Huang, C., Carey, V., "The effects of dissolved salt on the Leidenfrost transition", Int. J. Heat Mass Transfer 2007, 50 (1), 269-282.
Arnaldo del Cerro, D., Marin, A., Romer, G., Pathiraj, B., Lohse, D., Huis in 't Veld, "Leidenfrost point reduction in micro-patterned metallic surfaces", Langmuir 2012, 28, 15106-15110.
Bizi-Bandoki, P., Benayoun, S., Valette, S., Beaugiraud, B., Audouard, E., "Modifications of roughness and wettability properties of metals induced by femtosecond laser treatment", Appl. Surf Sci. 2011, 257 (12), 5213-5218.
Wang, Z., Zheng, H., Xia, H., "Femtosecond laser-induced modification of surface wettability of PMMA for fluid separation in micro channels", Microfluid. Nanofluid. 2011, 10 (1), 225-229.

(56) References Cited

OTHER PUBLICATIONS

Wu,J., Xia,J., Lei, W., Wang, B., "A one-step method to fabricate lotus leaves-like ZnO film", Mater. Lett. 2011, 65 (3), 477-479.
Baldacchini, T., Carey, J., Zhou, M., Mazur, E., "Super-hydrophobic surfaces prepared by microstructuring of silicon using a femtosecond laser", Langmuir 2006, 22 (11), 4917-4919.
Koch, K., Bhushan, B., Jung, Y., Barthlott, W., "Fabrication of artificial Lotus leaves and significance of hierarchical structure for superhydrophobicity and low adhesion", Soft Matter 2009, 5 (7), 1386-1393. (Abstract).
Stratakis, E., Ranella, A., Fotakis, C., "Biomimetic micro/nanostructured functional surfaces for microfluidic and tissue engineering applications", Biomicrofluidics 2011, 5, 013411.
Feng, L., Zhang, Y., Xi, J., Zhu, Y., Wang, N., Xia, F., Jiang, L., "Petal effect: a superhydrophobic state with high adhesive force", Langmuir 2008, 24, 4114-4119.
Tull, B., Carey, J., Mazur, E., McDonald, J., Yalisove, S., "Silicon surface morphologies after femtosecond laser irradiation", MRS Bull. 2006, 31, 626-633.
Wu, B., Zhou, M., Li, J., Ye, X., Li, G., Cai, L., "Superhydrophobic surfaces fabricated by microstructuring of stainless steel using a femtosecond laser", Appl. Surf Sci. 2009, 256, 61-66. (Abstract).
Nayak, B., Gupta, M., Kolasinski, K., "Spontaneous formation of nanospiked microstructures in germanium by femtosecond laser irradiation", Nanotechnology 2007, 18, 195302.
Nayak, B., Gupta, M., "Ultrafast laser-induced self-organized conical micro/nano surface structures and their origin", Optics and Lasers in Engineering 2010, 48, 966-973.
Her, T., Finlay, R., Wu, C., Mazur, E., Femtosecond laser-induced formation of spikes on silicon. Appl. Phys. A: Mater. Sci. Process. 2000, 70, 383-385.
Yong Hwang, T., Guo, C., "Polarization and angular effects of femtosecond laser-induced conical microstructures on Ni", J. Appl. Phys. 2012, 111, 083518-083518.
Zuhlke, C., Anderson, T., Alexander, D., "Formation of multiscale surface structures on nickel via above surface growth and below surface growth mechanisms using femtosecond laser pulses", Opt. Express 2013, 21, 8460-8473.
Tsibidis, G., Barberoglou, M., Loukakos, P., Stratakis, E., Fotakis, C., "Dynamics of ripple formation on silicon surfaces by ultrashort laser pulses in subablation conditions", Phys. Rev. B 2012, 86, 115316.
Sanchez, F., Morenza, J., Trtik, V., "Characterization of the progressive growth of columns by excimer laser irradiation of silicon", Appl. Phys. Lett. 1999, 75, 3303-3305.
Crouch, C., Carey, J., Warrender, J., Aziz, M., Mazur, E., Genin, F., "Comparison of structure and properties of femtosecond and nanosecond laser-structured silicon", Appl. Phys. Lett. 2004, 84, 1850-1852.
Dolgaev, S., Lavrishev, S., Lyalin, A., Simakin, A., Voronov, V., Shafeev, G., "Formation of conical microstructures upon laser evaporation of solids", Appl. Phys. A: Mater. Sci. Process. 2001, 73, 177-181.
Pedraza, A. Fowlkes, J., Lowndes, D., "Self-organized silicon micro column arrays generated by pulsed laser irradiation", Phys. A: Mater. Sci. Process. 1999, 69, 731-734.
Wenzel, R., "Surface Roughness and Contact Angle" J. Phys. Chem. 1949, 53, 1466-1467.
Vorobyev, A., Guo, C., "Metal pumps liquid uphill", Appl. Phys. Lett. 2009, 94, 224102-224102.
Vorobyev, A., Guo, C., "Laser turns silicon superwicking", Opt. Express 2010, 18, 6455-6460.
Tran, T., Staat, H., Prosperetti, A., Sun, C., Lohse, D., "Drop impact on superheated surfaces", Phys. Rev. Lett. 2012, 108, 036101.
Avedisian, C., Koplik, J., "Leidenfrost boiling of methanol droplets on hot porous/ceramic surfaces", Int. J. Heat Mass Transfer 1987, 30, 379-393. (Abstract).
Quere, D., "Leidenfrost Dynamics", Annu. Rev. Fluid Mech. 2013, 45, 197-215.
Kietzig, A., Hatzikiriakos, S., Englezos, P., "Patterned superhydrophobic metallic surfaces", Langmuir 2009, 25,4821-4827.
Zuhlke, "Control and Understanding of the Formation of Micro/Nanostructured Metal Surfaces Using Femtosecond Laser Pulses," UMI No. 3546643 (2012).

* cited by examiner

LEIDENFROST DROPLET MICROFLUIDICS

CROSS-REFERENCE TO RELATED APPLICATIONS

The present application claims the benefit under 35 U.S.C. § 119(e) of U.S. Provisional Application Ser. No. 61/926,436, filed Jan. 13, 2014, and titled "Leidenfrost Droplet Microfluidics," which is hereby incorporated by reference in its entirety.

FEDERALLY SPONSORED RESEARCH OR DEVELOPMENT

This invention was made with Government support under Grant No. FA9451-12-D-0195 awarded by the Air Force Research Laboratory. The Government has certain rights in this invention.

BACKGROUND

The field of microfluidics generally involves the design of systems for the manipulation of minute volumes of fluids, such as through generation of microvolumes of fluids, movement of microvolumes of fluids, heat transfer associated with microvolumes of fluids, and the like. At the microscale, fluids can behave in ways that differ from the behavior associated with the same fluids at the macroscale. These differences can be exploited to design microfluidic systems suitable for chemical applications, biological applications, medicinal applications, and so forth.

SUMMARY

A microfluidic device includes, but is not limited to, a solid structure having a patterned surface, the patterned surface including at least a first patterned region having a first Leidenfrost temperature with respect to a fluid material and a second patterned region having a second Leidenfrost temperature with respect to the fluid, the first patterned region adjacent to the second patterned region, the first patterned region defining a path over which a droplet of the fluid is configured to travel in a Leidenfrost state.

A system includes, but is not limited to, a microfluidic device and a heating element, the microfluidic device including, but not limited to, a solid structure having a patterned surface, the patterned surface including at least a first patterned region having a first Leidenfrost temperature with respect to a fluid material and a second patterned region having a second Leidenfrost temperature with respect to the fluid, the first patterned region adjacent to the second patterned region, the first patterned region defining a path over which a droplet of the fluid is configured to travel in a Leidenfrost state; the heating element coupled to the first patterned region and the second patterned region, the heating element configured to heat the first patterned region to the first Leidenfrost temperature and to heat the second patterned region to the second Leidenfrost temperature.

A method includes, but is not limited to, introducing a liquid droplet to a Leidenfrost microfluidic device, regulating a temperature of the first patterned region to the first Leidenfrost temperature, regulating a temperature of the second patterned region to the second Leidenfrost temperature, and propelling the liquid droplet along the path at the Leidenfrost state.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DRAWINGS

The detailed description is described with reference to the accompanying figures. In the figures, the use of the same reference numbers in different instances in the description and the figures may indicate similar or identical items.

DETAILED DESCRIPTION

Overview

Figure 1:
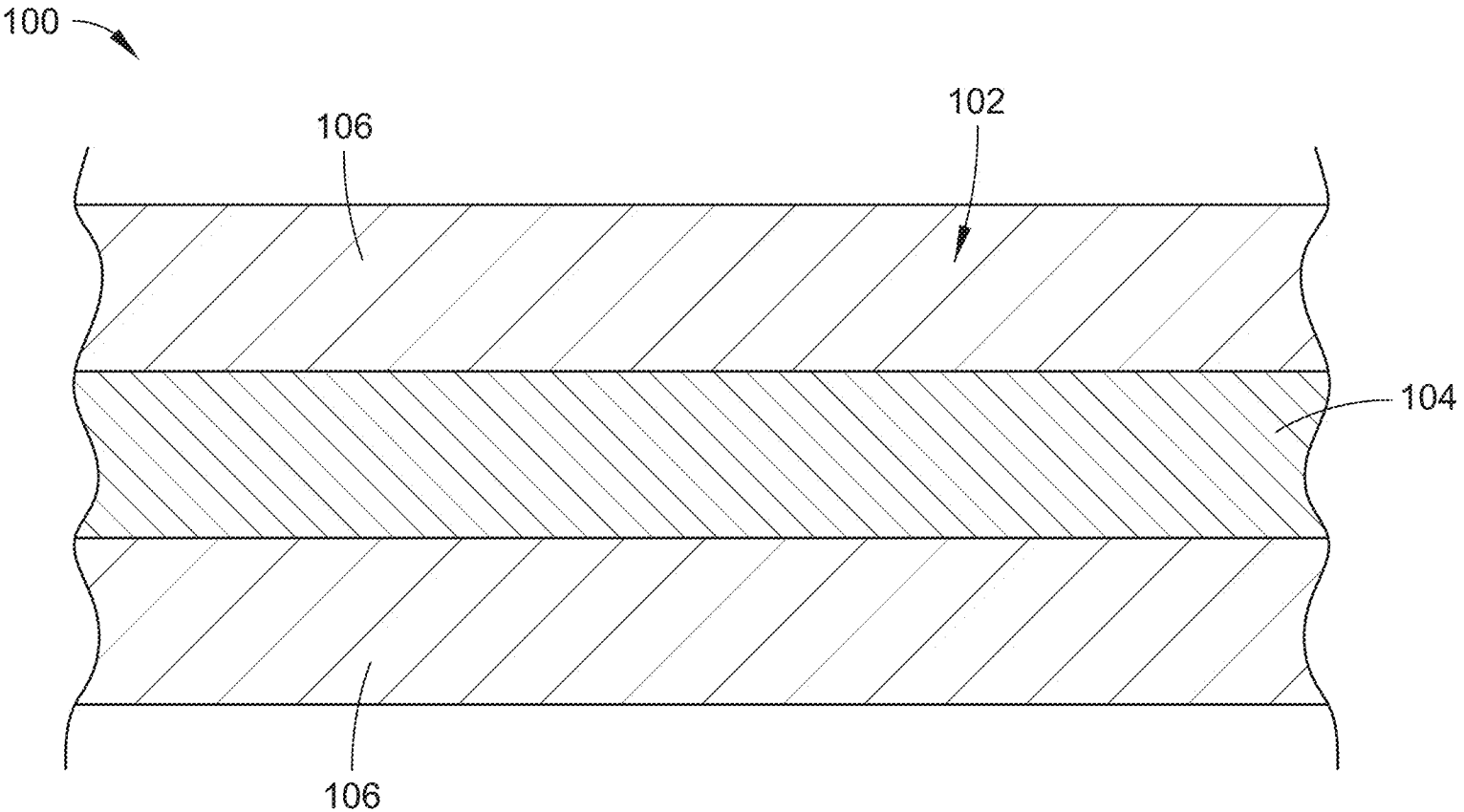
FIG. 1 is a diagrammatic top view of a microfluidic device in accordance with an example implementation of the present disclosure.

Microfluidic technologies can be used in various applications where it is desirable to manipulate and control small amounts of fluids (e.g., nanoliter-scale and microliter-scale). Microfluidic devices can include continuous flow microfluidic devices and digital microfluidic devices. Continuous flow microfluidics generally involves the manipulation of small amounts of liquids in three-dimensional microchannels via pressure-driven or electrokinetic-driven flows, both of which generally require external forces to maintain the pressure and to maintain the electrokinetic forces, which can be costly and inefficient. Digital microfluidics generally involves the discrete manipulation of small amounts of liquid, such as via electrowetting processes, which utilize applications of electric fields on circuitry to influence the wetting properties of a surface. In the instant disclosure, microfluids are controlled via precise manipulation of liquid droplets in the Leidenfrost state, which demonstrate virtually frictionless-motion of a liquid above a solid surface via an intervening vapor phase.

When a liquid droplet is placed on a heated surface at a temperature above the saturation temperature of the liquid, the droplet evaporates relatively quickly as a result of efficient nucleate boiling. Nucleate boiling is generally characterized by high heat transfer coefficients from the generation of vapor at a number of favored locations (e.g., nucleation sites) on the heated surface. With increasing temperature and heat flux (e.g., near the critical heat flux), the formation of more vapor in the vicinity of the surface has the effect of gradually insulating the heated surface. At high enough temperatures, these vapor pockets form a stable vapor film and result in a minimum heat flux. The corresponding temperature to this minimum heat flux is referred to as the Leidenfrost temperature. A droplet in the Leidenfrost state is accordingly supported above a surface in a nearly frictionless state by the vapor layer, requiring very little force to initiate and sustain droplet motion. For instance, a liquid droplet in the Leidenfrost state levitates above a solid surface on a cushion of its own vapor and can therefore move freely above the surface without significant resistance from the surface (e.g., from friction, surface tension, and the like). Due to the lack of friction, a droplet in the Leidenfrost state can self-propel across the surface as a result of measured evaporation of the droplet (e.g., to maintain the stable vapor film) and inhomogeneity of the surface (see, e.g., Kruse et al., "Extraordinary Shifts of the Leidenfrost Temperature from Multi scale Micro/Nanostructured Surfaces," *Langmuir,* 29, 9798-9806 (2013), which is incorporated herein by reference).

Accordingly, the present disclosure is directed to systems and methods for the manipulation of a path of travel of a droplet in the Leidenfrost state. In implementations, the path of the droplet is defined by placing two dimensional boundaries, termed Leidenfrost Energy Barriers, along the trajectory of a desired droplet path. In implementations, the boundaries are provided by patterning a surface (e.g., a heated surface) with regions having different Leidenfrost temperatures with respect to the droplet. The Leidenfrost Energy Barriers can prevent the crossing of droplets from one region to another to thereby define a preferred path of travel of the droplet in the Leidenfrost state. The patterned surfaces can include angled microstructures oriented in specific directions (e.g., directional surfaces) having unidirectional properties associated with the path of travel of the droplet to control of the speed and direction of the droplet, where asymmetries in the patterned surfaces can cause the droplet to move in a preferred direction, with speed being governed by a degree of asymmetry.

In the following discussion, example structures for Leidenfrost Droplet Microfluidics and implementations of techniques for manipulation of a path of travel of a droplet in the Leidenfrost state are presented.

EXAMPLE IMPLEMENTATIONS

Referring to FIG. 1, a microfluidic device 100 is provided from a top view perspective. As shown, the microfluidic device 100 includes a patterned surface 102 having a first patterned region 104 and a second patterned region 106. The patterned surface 102 is generally composed of any material suitable for inducing a liquid material into a Leidenfrost state, such as through heating of the surface. Accordingly, in implementations the patterned surface is composed of a material with low thermal mass, that can alter a Leidenfrost temperature, and that can achieve surface asymmetry during patterning processes. While two patterned regions are shown (with the second patterned region 106 adjacent to and/or surrounding the first patterned region 104), the instant disclosure is not limited to two patterned regions, where the patterned surface 102 can include more than two (e.g., three or more) patterned regions in various configurations. In implementations, the first patterned surface 104 has a first Leidenfrost temperature with respect to a fluid material (e.g., a microfluid droplet), whereas the second patterned surface 106 has a second Leidenfrost temperature with respect to the fluid material to thereby provide a Leidenfrost Energy Barrier between the first patterned surface 104 and the second patterned surface 106. The Leidenfrost Energy Barrier prevents travel of a droplet of the fluid material from the first patterned surface 104 to the second patterned surface 106, and instead controls or constrains the path of travel to the first patterned surface 104. The differing Leidenfrost temperatures between surfaces can be attributed at least in part to the differing configuration of microstructures of the surfaces (see, e.g., Kruse et al., ibid, incorporated by reference herein). In general, the patterned regions of the patterned surface 102 are functionalized surfaces to provide one or more of controlled wettability, capillary wicking, micro/nano structured features, and so forth. The patterning can be applied to a surface of a material through a variety of processing techniques including, but not limited to, ultrashort laser surface processing (e.g., femtosecond laser surface processing (FLSP)), coating, or other film deposition techniques (e.g., atomic deposition). In implementations, the first patterned region 104 and the second patterned region 106 are patterned via FLSP processing techniques to provide functionalized surfaces through a combination of growth mechanisms including, but not limited to, preferential ablation, capillary flow of laser-induced melt layers, and redeposition of ablated surface features.

Figure 8:
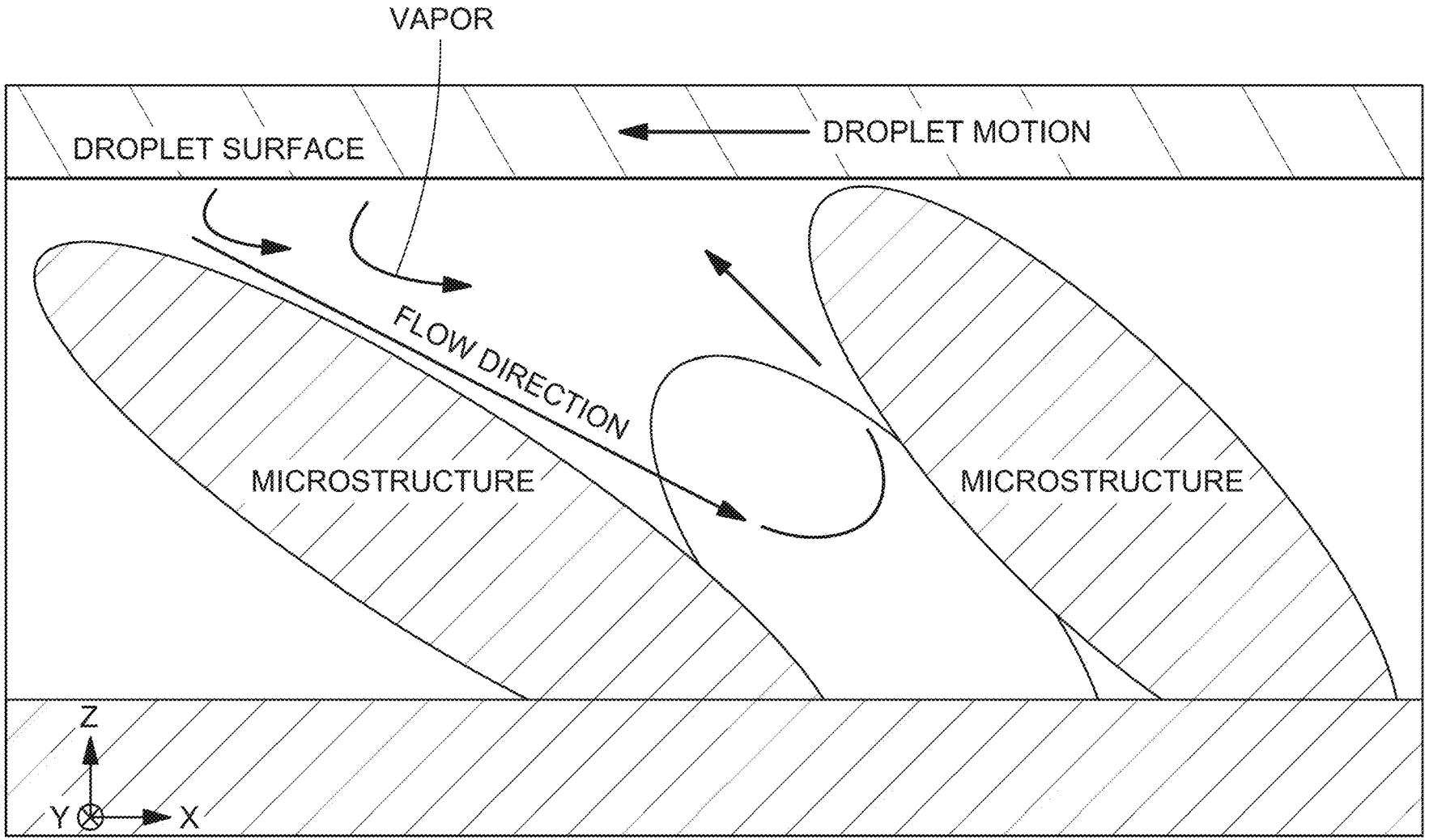
FIG. 8 is a schematic diagram of the flow of vapor from a droplet and direction of motion of the droplet on a structure treated/patterned by femtosecond laser surface processing (FLSP) in accordance with an example implementation of the present disclosure.

In implementations, the FLSP processing techniques are utilized to provide the first patterned region 104 with one or more of a below-surface-growth (BSG) mound pattern, an above-surface-growth (ASG) mound pattern, and a nanostructure-covered pyramid (NC-pyramid) pattern, which are described in Kruse et al., ibid, incorporated by reference herein. Similarly, the FLSP processing techniques can be utilized to provide the second patterned region 106 with one or more of a below-surface-growth (BSG) mound pattern, an above-surface-growth (ASG) mound pattern, and a nanostructure-covered pyramid (NC-pyramid) pattern. In general, FLSP conditions such as laser fluence, incident pulse count, polarization, and incident angle, can be varied to generate varying microstructure patterns, such as the size, density, and type of micrometer and nanometer-scale surface features that make up the BSG mound patterns, the ASG mound patterns and the NC-pyramid mound patterns. In implementations, the patterning of the first patterned region 104 differs from the second patterned region 106 to provide the Leidenfrost Energy Barrier at the junction between the respective regions. For example, in an implementation, the first patterned region includes at least one of a below-surface-growth (BSG) mound pattern, an above-surface-growth (ASG) mound pattern, and a nanostructure-covered pyramid (NC-pyramid) pattern, and the second patterned region includes a different pattern including at least one of a below-surface-growth (BSG) mound pattern, an above-surface-growth (ASG) mound pattern, and a nanostructure-covered pyramid (NC-pyramid) pattern, such as to utilize the Leidenfrost Energy Barrier to constrain the path of travel of a liquid droplet to the first patterned region 104, and to avoid having the droplet travel to the second patterned region 106 due to the presence of the Leidenfrost Energy Barrier. Directionality of the travel path of the droplet can be controlled, which is described with regard to FIGS. 2 and 8 below. Velocity of the travel path can also be controlled, which is described with regard to Example 1 below.

Figure 2:
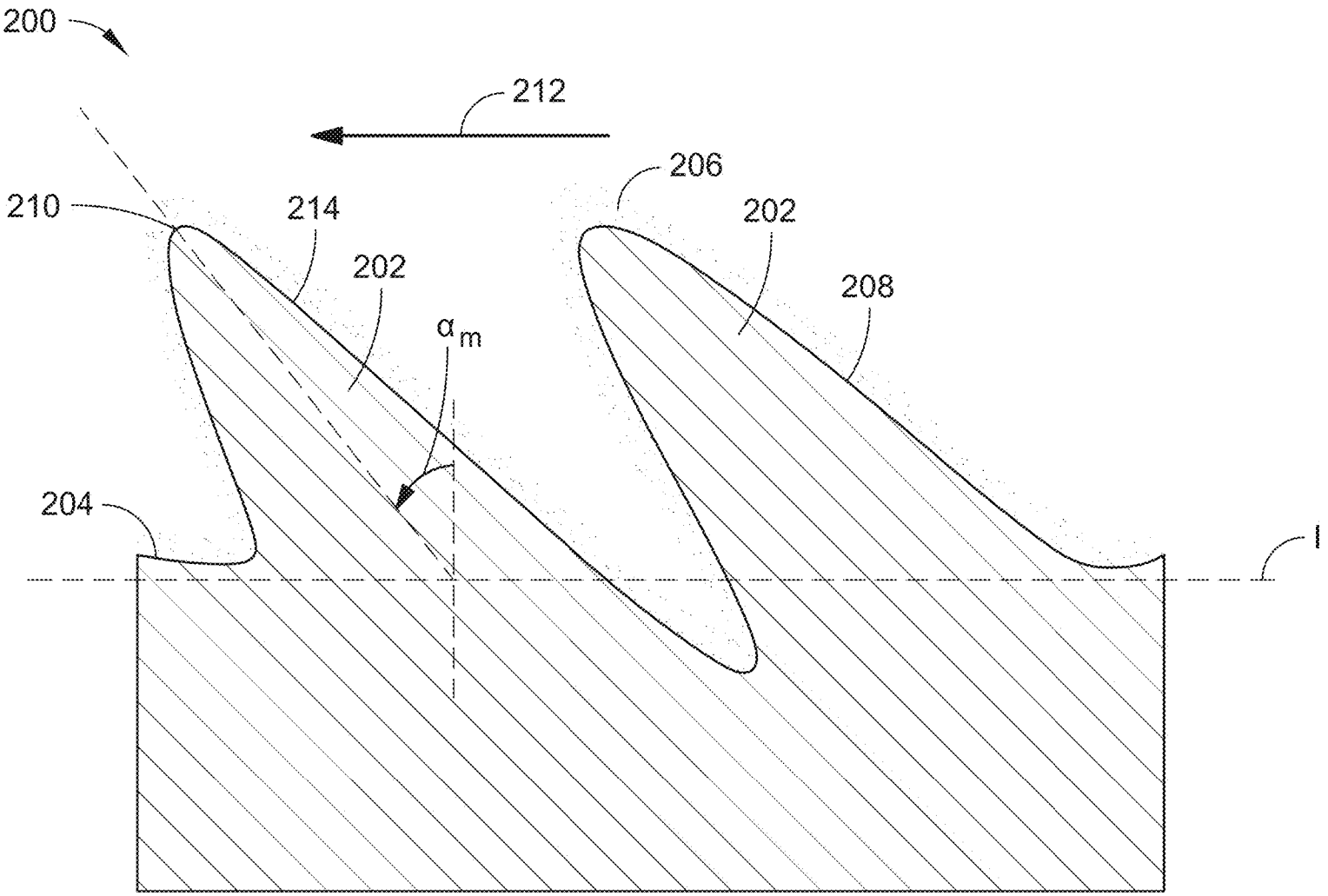
FIG. 2 is a schematic cross-sectional diagram of a patterned physical surface in accordance with an example implementation of the present disclosure.

Referring to FIG. 2, a patterned surface 200 is shown with a plurality of microstructures 202 protruding at an angle from a substrate material 204. The microstructures 202 include a layer of nanoparticles 206 positioned on (e.g., formed on) a surface 208, 214 of the microstructures 202. In implementations, the substrate material 204 is physically patterned to produce the microstructures 202 and the nanoparticles 206 positioned on the surface 208, 214, such as through techniques including, but not limited to femtosecond laser surface processing (FLSP), which can develop the layer of nanoparticles 206 through a combination of growth mechanisms including, but not limited to, preferential ablation, capillary flow of laser-induced melt layers, and redeposition of ablated surface features. In implementations, by controlling FLSP conditions such as laser fluence, incident pulse count, polarization, and incident angle, the size and density of both micrometer and nanometer-scale surface features can be tailored to thereby produce a multiscale metallic surface, which can affect heat transfer associated with, inter alia, Leidenfrost temperature control (see, e.g., Kruse et al., ibid; Zuhlke, "Control and Understanding of the Formation of Micro/Nanostructured Metal Surfaces Using Femtosecond Laser Pulses," UMI Number: 3546643; Zuhlke et al., "Comparison of the structural and chemical composition of two unique micro/nanostructures produced by femtosecond laser interactions on nickel," Appl. Phys. Lett. 103, 121603 (2013); Zuhlke et al., "Fundamentals of layered nanoparticle covered pyramidal structures formed on nickel during femtosecond laser surface interactions," Applied Surface Science 283 (2013), 648-653, which are incorporated herein by reference).

The microstructures 202 protrude from the substrate material 204 at an angle that can depend on the processing technique utilized to provide the microstructures 202. For example, with an FLSP technique, the incident angle of the laser can define the angle of protrusion of the microstructures 202 formed thereby. As shown in FIG. 2, the microstructure 202 is shown to protrude at an angle (shown as am) measured from normal to a horizontal plane (I) to a peak 210 of the microstructure, which may correspond to an incident angle of the laser used to treat the substrate material 204. In implementations, the microstructures 202 are angled between zero degrees and seventy degrees from normal to the horizontal plane (I). However, the present disclosure is not limited to such range, where the orientation of the microstructures 202 and the precision thereof can vary depending on the material type of the substrate material 204, limitations associated with fabrication techniques used to pattern the substrate material 204, and so forth, and the angled microstructures 202 can therefor reasonably vary outside the aforementioned range of zero degrees and seventy degrees from normal relative to the horizontal plane (I).

A droplet of a liquid material in a Leidenfrost state would be suspended over the microstructures 202 via a stable vapor film. In this state, the motion is virtually frictionless due to the presence of the vapor film between the droplet and the patterned surface 200. Accordingly, very little energy is required to initiate or sustain motion of the droplet relative to the patterned surface 200. A travel direction of the droplet over the patterned surface is indicated by 212 in FIG. 2. As can be seen, the travel direction includes a horizontal component (e.g., the horizontal portion of the vector of travel 212 that is parallel to the horizontal plane I) that is in the same direction as a horizontal component of the angle (am) from normal to a top surface (e.g., to the peak 210) of the microstructure 202. Stated generally, the direction of motion of the liquid droplet in the Leidenfrost state above the patterned surface 200 is substantially oriented as in the general direction as pointed by the angled microstructures from the substrate material 204 to the peak 210. This is also conceptually provided in FIG. 8, described below, which considers the path of vapor evaporated from the liquid droplet during maintenance of the Leidenfrost state.

In implementations, the substrate material 204 and the microstructures 202 formed thereby are comprised of materials including, but not limited to, nickel, nickel alloy, gold, gold alloy, stainless steel alloy (e.g., 304 SS), titanium, titanium alloy, aluminum, aluminum alloy, copper, copper alloy, zirconium alloy (e.g., Zircaloy), silicon carbide, Inconel alloy (e.g., Inconel 740h), silicon, silicon alloy, germanium, germanium alloy, and mixtures thereof. In implementations, the nanoparticles 206 are comprised of the same materials as the microstructures 202, and can additionally or alternatively include oxides thereof.

Figure 3:
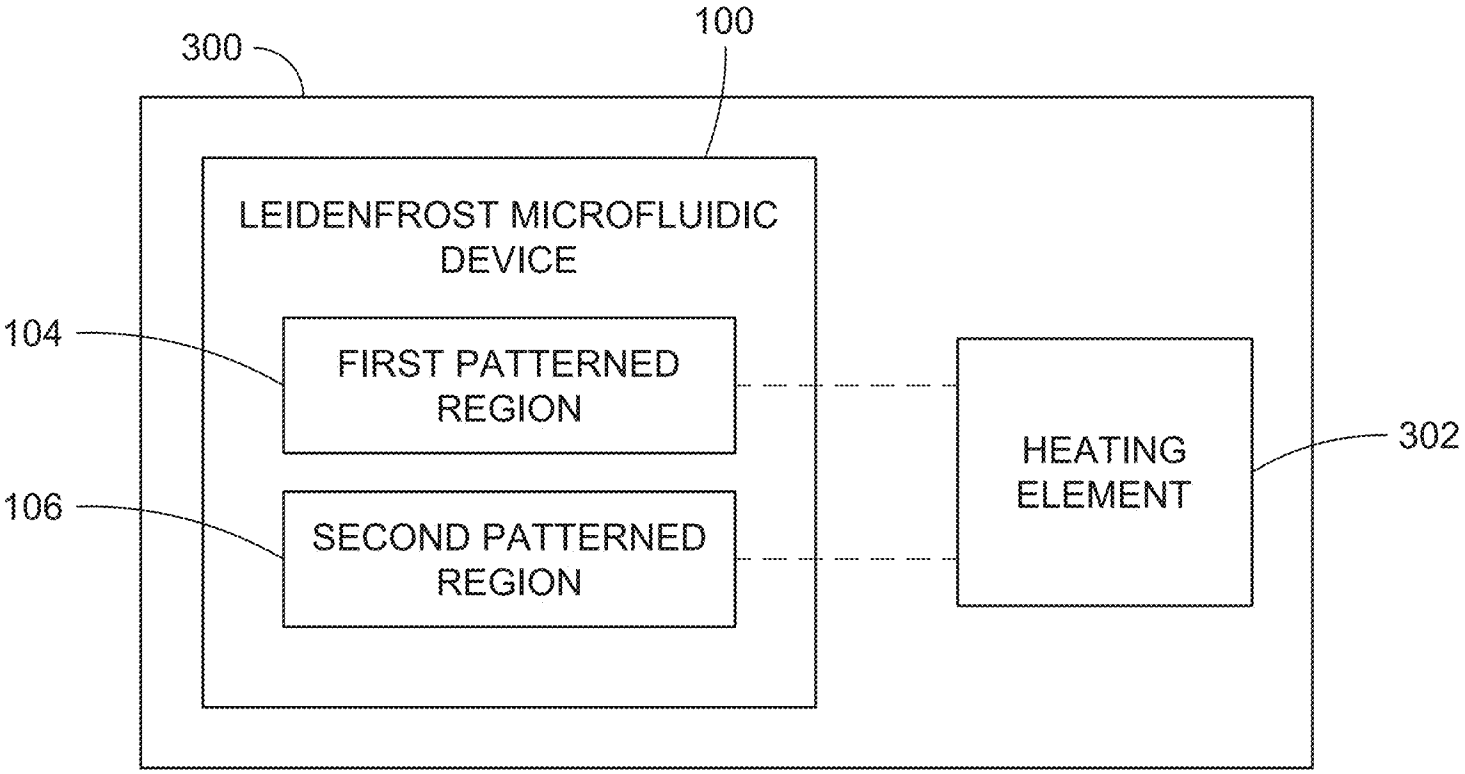
FIG. 3 is a diagram of a microfluidic system in accordance with an example implementation of the present disclosure.

Referring to FIG. 3, a system 300 for the manipulation or control of a path of travel of a droplet in the Leidenfrost state is provided. The system includes a Leidenfrost microfluidic device 100, (e.g., as described with reference to FIG. 1 to include a first patterned region 104 and a second patterned region 106) and a heating element 302 operably coupled to the Leidenfrost microfluidic device 100. In implementations, the heating element 302 is coupled to the first patterned region 104 and to the second patterned region 106 to regulate a temperature of the respective regions. For example, the heating element 302 can heat or regulate the heat of the first patterned region 104 to a first Leidenfrost temperature with respect to a fluid material and can heat or regulate the heat of the second patterned region 106 to a second Leidenfrost temperature with respect to the fluid material. In general, the heating element 302 can be any device sufficient to heat, maintain a temperature or heat flux, regulate a temperature or heat flux, and so forth, of the patterned regions of the Leidenfrost microfluidic device 100 in order to maintain a droplet in a Leidenfrost state on a path of travel on/above the first patterned region 104 while avoiding transfer to and travel on/above the second patterned region 106 due to the Leidenfrost Energy Barrier. For example, the heating element 302 can include, but is not limited to, a heating block with a plurality cartridge heaters to maintain the respective patterned surfaces at their respective Leidenfrost temperature values with respect to the fluid, and can further include one or more thermocouples configured to determine the temperature of the surface of the respective patterned regions, and can further include a temperature controller with a thermocouple feedback loop to control the surface temperatures of the respective patterned regions.

Example Methods

Figure 4:
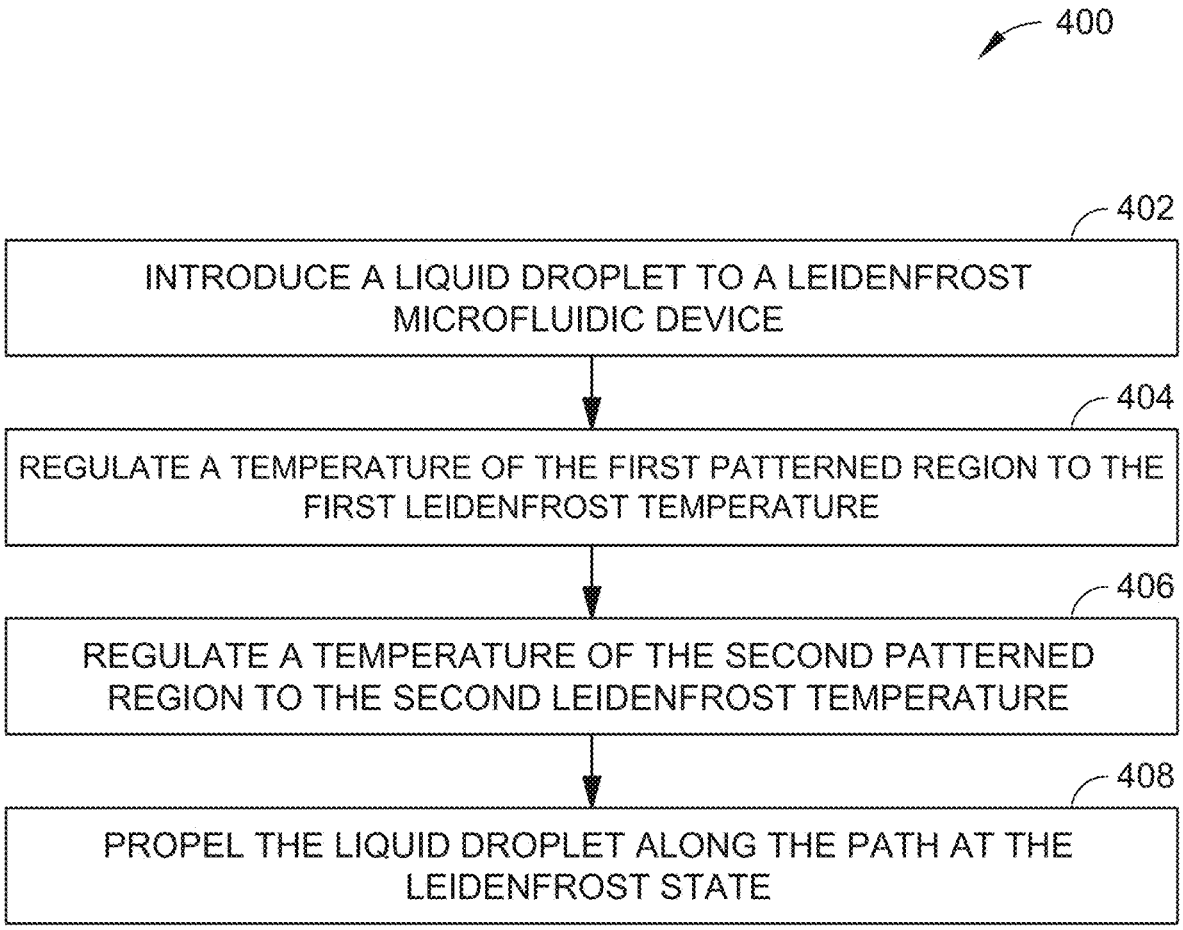
FIG. 4 is a flow diagram of a method for controlling the flow of a liquid droplet using a Leidenfrost droplet microfluidic device in accordance with an example implementation of the present disclosure.

Referring to FIG. 4, a flow diagram of a method 400 for manipulating or controlling a path of travel of a droplet in the Leidenfrost state is provided. Method 400 includes introducing a liquid droplet to a Leidenfrost microfluidic device in block 402. In implementations, the Leidenfrost microfluidic device includes the components of the microfluidic device 100 described above. For example, in implementations, the Leidenfrost microfluidic device includes a solid structure having a patterned surface, the patterned surface including at least a first patterned region having a first Leidenfrost temperature with respect to a fluid material and a second patterned region having a second Leidenfrost temperature with respect to the fluid, the first patterned region adjacent to the second patterned region, the first patterned region defining a path over which a droplet of the fluid is configured to travel in a Leidenfrost state.

Method 400 also includes regulating a temperature of the first patterned region to the first Leidenfrost temperature in block 404. For example, a heating element, such as heating element 302 can be utilized to heat, maintain a temperature or heat flux, regulate a temperature or heat flux, and so forth, of the first patterned region to provide the first Leidenfrost temperature with respect to the liquid droplet. Method 400 also includes regulating a temperature of the second patterned region to the second Leidenfrost temperature in block 406. For example, a heating element, such as heating element 302 can be utilized to heat, maintain a temperature or heat flux, regulate a temperature or heat flux, and so forth, of the second patterned region to provide the second Leidenfrost temperature with respect to the liquid droplet, thereby forming a Leidenfrost Energy Barrier with respect to the first patterned region and the second patterned region due to maintenance of the differing Leidenfrost temperatures. Method 400 further includes propelling the liquid droplet along the path at the Leidenfrost state in block 408. For example, the path is defined by the first patterned region, where the droplet can self-propel due to evaporation forces, drag forces, and so forth, while suspended by a stable vapor film between the droplet and the first patterned region. While propelling along the path defined by the first patterned region, the liquid droplet can be maintained along that path by the Leidenfrost Energy Barrier defined by the respective differences in Leidenfrost temperatures of the first and second patterned regions, thereby preventing the liquid droplet from traveling onto the second patterned region.

atmosphere during processing. Furthermore, surface features induced by one laser pulse affect the absorption of light from subsequent pulses, which results in feedback during formation.

The fabrication laser was a Ti: Sapphire (Spitfire, Spectra Physics) that produced pulses of approximately 50 femtoseconds duration with a central wavelength of 800 nm at a 1 kHz repetition rate. The laser power was controlled through a combination of a half-wave plate and a polarizer. The pulses were focused using a 125 mm focal length plano-convex lens (PLCX-25.4-64.4-UV-670-1064) with a broadband antireflection coating covering the laser spectrum. The sample was placed on a computer-controlled 3D translation stage and translated through the beam path of the laser in order to process an area larger than the laser spot size. The number of pulses incident on the sample was controlled by adjusting the translation speed of the sample. The angle of the surface structures was controlled by the incident angle of the laser on the target surface; the surface structures developed with peaks that point in the direction of the incident laser.

Two stainless steel samples were fabricated with microstructure angles of 45° and 10° with respect to the surface normal and then utilized to demonstrate the ability to self-propel Leidenfrost droplets. These samples are characterized by mound-shaped microstructures that are covered in a layer of nanoparticles and are angled versions of Above Surface Growth (ASG) Mound structures. Various fabrication parameters and surface characteristics of the two samples are provided in Table 1. The two samples were fabricated with the same pulse energy. Because the laser was incident on the sample at an angle for each sample, the spot on the sample was elliptical, resulting in a differing size for each sample. The elliptical beam profile on the target sample (see FIG. 5A) is due to the non-normal incident angle of the laser. The parallel and perpendicular dimensions given in Table 1 refer to spot size dimensions relative to the laser direction.

TABLE 1

Laser Parameters and Surface characteristics.

| Structure Angle | Pulse Energy (μJ) | Number of Laser Shots | Spot Dia. (μm) (Parallel) | Spot Dia. (μm) (Perpendicular) | Peak-to-Valley Height (μm) | Structure Spacing (Parallel) (μm) | Structure Spacing (Perpendicular) (μm) |
|---|---|---|---|---|---|---|---|
| 45 | 700 | 500 | 328 | 232 | 17 | 27 | 17 |
| 10 | 700 | 500 | 188 | 224 | 57 | 29 | 30 |

EXAMPLE IMPLEMENTATIONS

Example 1

Figure 5B:
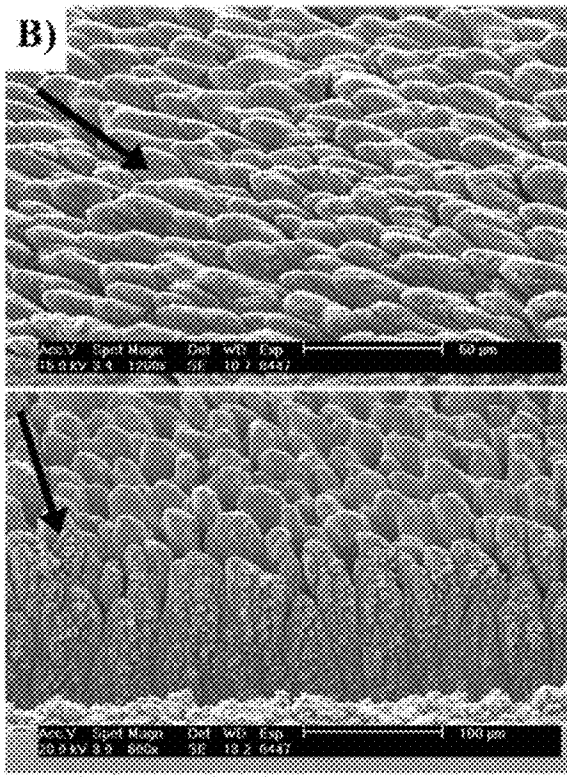
FIG. 5B is an SEM image of a side view of two laser treated surfaces in accordance with example implementations of the present disclosure.
Figure 5A:
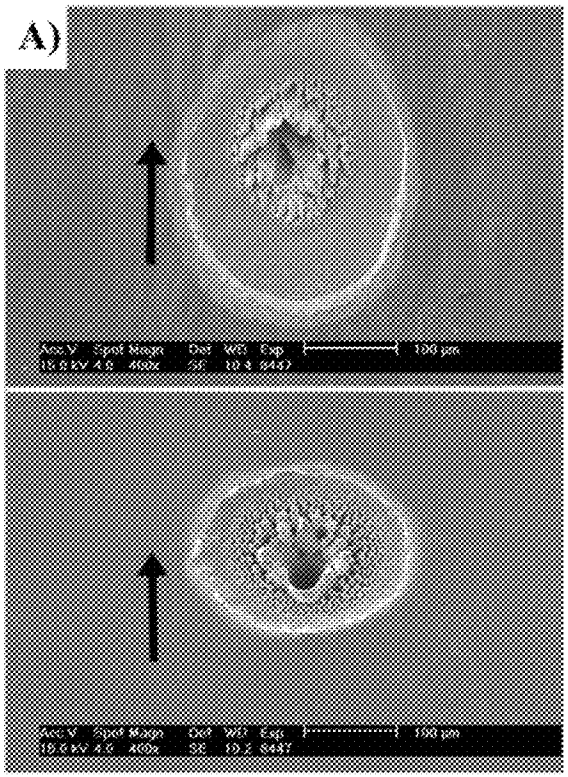
FIG. 5A is a scanning electron microscope (SEM) image of two laser treated surfaces in accordance with example implementations of the present disclosure.
Figure 5D:
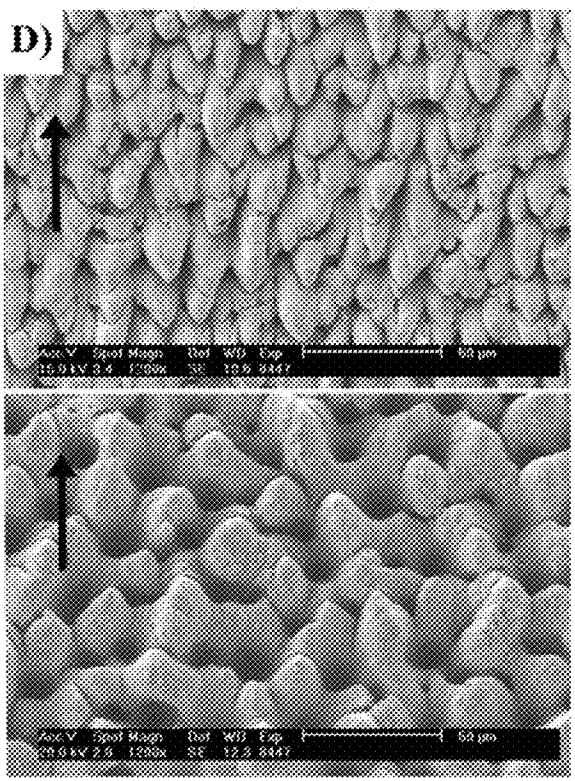
FIG. 5D is an SEM image of two laser treated surfaces viewed from normal to the surfaces in accordance with example implementations of the present disclosure.
Figure 5C:
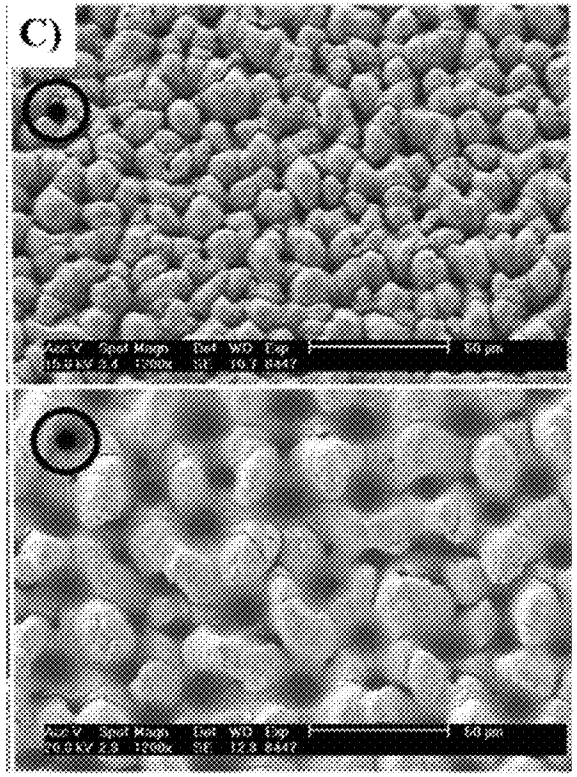
FIG. 5C is an SEM image of two laser treated surfaces viewed from the direction of incident laser pulses used to treat/pattern the surfaces in accordance with example implementations of the present disclosure.

A Femtosecond Laser Surface Processing (FLSP) technique was used to generate 316 stainless steel surfaces with a quasi-periodic pattern of angled surface microstructures. Surface features (i.e. microstructures and nanostructures), generated using the FLSP technique, are formed by directly shaping the surface of the bulk material through absorption of energy from multiple femtosecond laser pulses. Absorption of laser energy initiates a complex combination of multiple self-organized growth mechanisms including laser ablation, capillary flow of laser-induced melt layers, and redeposition of ablated material. The size and shape of the features are controlled through fabrication parameters including the laser fluence, the number of laser shots per area incident on the sample, the laser incident angle, and the Referring to FIGS. 5A-5D, scanning electron microscope (SEM) images of the two samples are provided, where the top image of each SEM image relates to the 45 degree sample and where the bottom image relates to the 10 degree sample. The arrows on the images represent the projected direction of the incident laser pulses used to form the samples. FIG. 5A provides images of a laser damage site on the target samples after exposure to 500 laser pulses with a pulse energy of 700 μJ, where each image is 400× with a 100 μm scale bar. FIG. 5B provides images viewed from the side of the samples, where the top image is 1200× with a 50 μm scale bar, and the bottom image is 600× with a 100 μm scale bar. FIG. 5C provides images viewed from the direction of the incident laser pulses (e.g., 45 degrees from normal for the top image, 10 degrees from normal for the bottom image), where each image is 1200× with a 50 μm scale bar. FIG. 5D provides images viewed normal to the surface of each sample, where the images are 1200× with a 50 μm scale.

Figure 6:
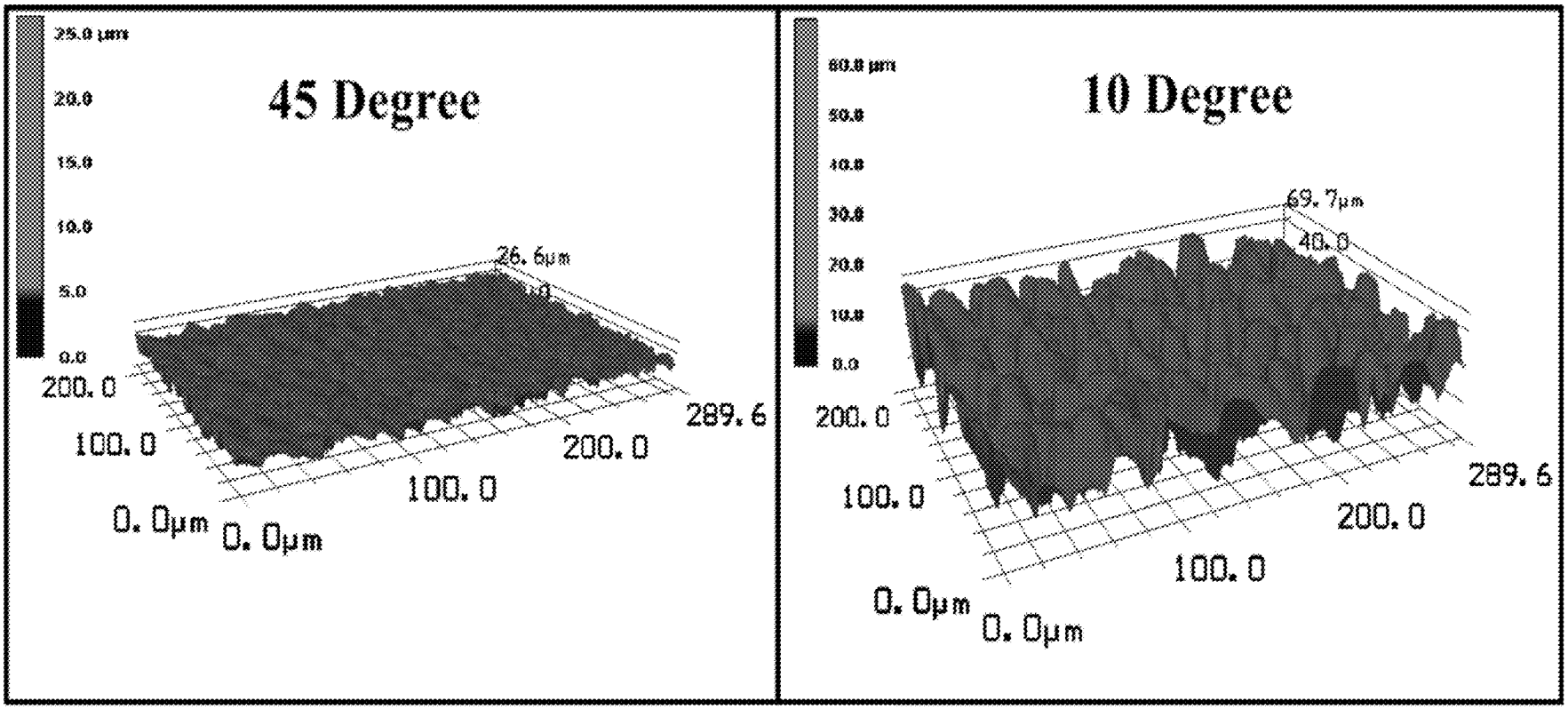
FIG. 6 is a 3D surface profile for each of two laser treated samples in accordance with example implementations of the present disclosure.

The structure spacing values in Table 1 were obtained by a 2D Fast Fourier Transform (FFT) analysis of the images in FIG. 5C and represent the peak values in the directions parallel and perpendicular to the laser. The peak-to-valley structure heights were measured using a 3D Confocal Laser Scanning Profilometer (Keyence, VK-X200); these images are shown in FIG. 6 and correspond to the same surfaces imaged in represented in FIGS. 5A-5D. These images were taken at a viewing angle normal to the sample surface. The markedly smaller peak-to-valley structure heights of the 45° sample relative to the 10° sample are due to the larger spot size (see Table 1 and FIG. 5A) and thus decreased laser fluence on the sample. This relatively lower laser fluence results in decreased surface fluid flow during processing and thus reduced structure development. The two samples were superhydrophilic; this was determined by measuring 0° contact angles with a Ramé-Hart Goniometer. Due to the superwicking nature of the surface, the droplet would perfectly wet the surface and was not able to be directly imaged. The superhydrophilic nature of the surface is a result of the fabrication process.

Each of the experimental samples was fabricated on a 2.5"×1" piece of polished 316 stainless steel plate. The laser-structured area was 0.5" wide and 2" long and was located in the center of the plate. Each processed sample was then placed onto a leveled copper heating block heated by five cartridge heaters. Four K-type thermocouples (Omega 5TC-GG-K-36-72) were epoxied (Omega OB-200-2) to the surface of the test sample in order to accurately determine the surface temperature. The surface temperature was monitored with the use of control system software tools (e.g., LabVIEW). The surface temperature was controlled through the use of a Ramé-Hart precision temperature controller (Ramé-Hart 100-50) and a thermocouple feedback loop. Droplet size and dispensing was controlled by a Ramé-Hart computer controlled precision dropper (Ramé-Hart 100-22). Deionized water was used as the working fluid with droplet sizes of 10.5 μL (diameter of 2.8 mm). This size was chosen because it corresponds to the droplet size that easily detaches from the needle by gravity alone. Droplets were released close to the surface to limit the effects of the impact velocity. From high speed video analysis, using two successive frames immediately before impact, it was determined that the droplets impacted the surface with a velocity of approximately 20 cm/s. This corresponds to a Weber number of around 1.5 which is considered to be relatively small. The Weber number can be determined via the following equation:

$$We=(\rho D_0 V_0^2)/\sigma \quad (1)$$

where ρ is the liquid density, $D_0$ is the droplet diameter, $V_0$ is the impact velocity, and σ is the surface tension. At room temperature, ρ=998 kg/m$^3$ and σ=73 mN/m.

All videos were recorded with the use of a high speed camera (Photron Fastcam SA1.1), set at 250 frames per second. From the high speed video images, droplet velocities across the samples were calculated using a Matlab droplet tracking program which tracks the centroid of the droplet. This program calculates the instantaneous horizontal droplet velocity between successive frames and then gives an average velocity profile for the entire droplet motion. The program was validated against droplet velocities manually calculated from still images using a movie editing software; the two methods were in excellent agreement.

Figure 7:
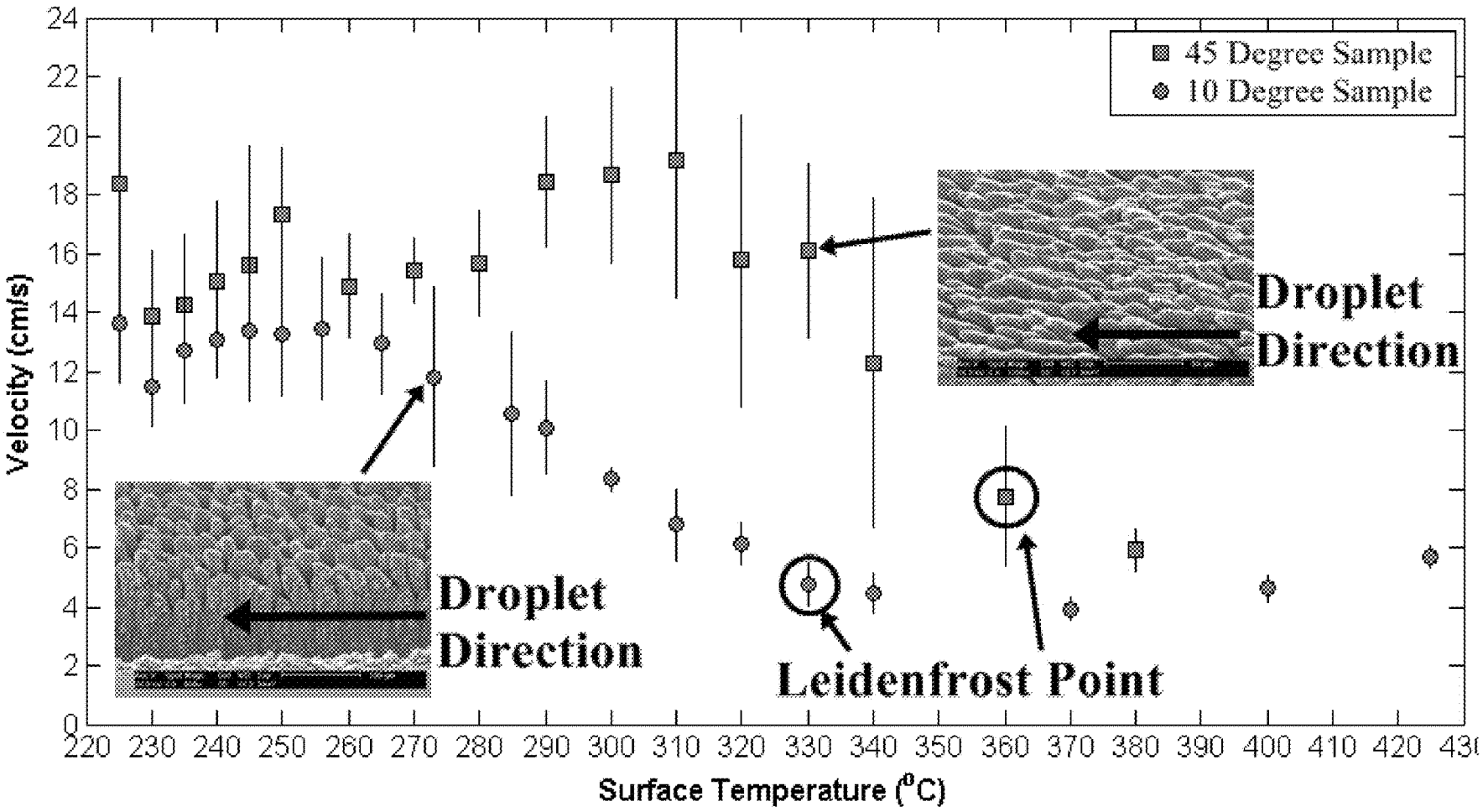
FIG. 7 is a diagram of velocity versus surface temperature corresponding to droplet motion experiments for two laser treated samples in accordance with example implementations of the present disclosure.

The data obtained from the droplet motion experiments for the two distinct angled microstructures are shown in FIG. 7. Droplets were released onto the surface about 0.5" from one processed end, leaving about 2.0" of processed length for the droplet to traverse. Velocities presented in FIG. 7 correspond to the maximum droplet velocities at the edge of the processed surface. Each velocity data point corresponds to an average velocity of ten individual droplets and the error bars correspond to the standard deviation of these ten droplets. As can be seen from the graph, the two curves have similar features yet significant differences. Both curves exhibit a local maximum towards lower surface temperatures. The 45 degree sample has a maximum velocity of 19.2 cm/s at a surface temperature of 310° C. while the 10 degree sample has a maximum velocity of 13.5 cm/s at a surface temperature of 256° C. For both samples, droplet velocities gradually decrease as the surface temperature is decreased from the maximum observed velocities. At the lowest temperature recorded, both samples displayed a spike in the droplet velocity. In the case of the 10 degree sample, this spike in velocity was nearly the same as the local maximum found at 256° C. Velocities could not be recorded below 225° C. as violent nucleate boiling resulted in the destruction of the liquid droplets. Although the droplet velocities were relatively high at the lowest temperatures, the motion is relatively unstable due to the possibility of nucleate boiling and is thus undesirable for most applications. As the surface temperature is increased beyond the value at the maximum droplet velocity, droplet velocities again decrease but at a much faster rate, especially for the 45 degree sample.

The results shown in FIG. 7 provide at least two regions of interest for each sample, which correspond to temperatures above and below the Leidenfrost temperature of the surface of each sample. The Leidenfrost temperatures for the 10° and 45° sample were estimated to be 330° C. and 360° C., respectively. The Leidenfrost temperature of each surface was estimated by the change in the slope of the curves and the standard deviations of the velocities (FIG. 7) as well as the visual differences in the droplet behavior, captured with the high speed video images. The slope of the curves in FIG. 7 changes at 330° C. and 360° C. for the 10° and 45° samples, respectively. To the left of these temperatures, the standard deviations are significantly larger. This indicates that intermittent contact between the droplet and the surface is occurring and the droplet is not in a stable film boiling state. Because this intermittent contact promotes an explosive type of energy transfer, it results in a wide range of droplet velocities and thus larger standard deviations. High speed images of the droplets at temperatures below the Leidenfrost temperature for both samples (e.g., 320° C. for the ten degree sample, 340° C. for the forty five degree sample) and at the Leidenfrost temperature for both samples (e.g., 330° C. for the ten degree sample, and 360° C. for the forty five degree sample) show a distinct visual difference in the images of the droplets between the two temperatures for each sample. For both samples, the droplets appear to be white in color and asymmetrical (e.g., non-spherical shape characteristics) at temperatures below the Leidenfrost temperature. This indicates that the droplets are being disturbed by intermittent contact. At these temperatures, it can also be seen from the high speed video that the droplets tend to jump and bounce much more frequently and eject smaller satellite drops. This is characteristic of not having a fully developed vapor film between the droplets and the heated surface and thus below the Leidenfrost region. Flow/thermal instabilities lead to the non-spherical shapes and ejection of satellite droplets. At temperatures at or above the Leidenfrost temperature, the droplets appear to be very spherical and clear in color. This is due to the stable vapor film below the droplet. The Leidenfrost temperatures estimated by this technique are within the expected range for surfaces created by a femtosecond laser process. The variation in the Leidenfrost temperature between the two samples is due to the differences in the surface microstructures (see, e.g., Kruse et al., ibid, incorporated by reference herein).

In general, there are two mechanisms that aid to the motion of the droplet. The dynamic balance between these two mechanisms results in the characteristics of the velocity curves shown in FIG. 7. At temperatures below the Leidenfrost temperature, droplet motion results from the directional ejection of vapor due to intermittent contact between the liquid droplet and microstructures. When this intermittent contact happens, heterogeneous boiling occurs and vapor is violently released from the droplet resulting in higher droplet velocities. This heterogeneous boiling is likely the cause of the velocity spikes for both samples at 225° C. At these lower temperatures contact is more likely to happen and energy is more easily transferred to the droplet. At temperatures above the Leidenfrost temperature, a stable vapor film is created and thus intermittent contact between the droplet and microstructures is less likely to happen. At these temperatures, the droplet motion mechanism is dominated by viscous stresses that drag the droplet in the direction of the vapor flow. Because this mechanism is not abrupt like in the case of intermittent contact, it produces a smaller but more stable force on the droplet and consequently slower velocities. The local maximums for both samples are most likely due to an optimal combination of these two mechanisms.

The overall larger velocities of the 45 degree sample relative to the 10 degree sample can be attributed to the difference in microstructure angle between the two samples. The 45 degree angle results in a more favorable horizontal force component on the droplet during intermittent contact at lower temperatures. The differences at higher temperatures can be explained by a combination of the microstructure size and the viscous drag mechanism. For the 10 degree sample, the droplet velocity decreases very rapidly with increasing temperatures to reach what seems to be a local velocity plateau (e.g., 370° C.). At temperatures higher than 370° C. in the case of the 10 degree sample, droplet velocities increase with increasing temperatures due to the increased heat flux to the droplet and a corresponding higher vapor flow velocity. No velocities were recorded for the 45 degree sample above 380° C. because the droplet no longer displayed a preferential directionality. In these temperature ranges there is little to no intermittent contact and the dominant mechanism is the viscous drag mechanism. The 45 degree sample has microstructure heights significantly smaller than the 10 degree sample (see Table 1). This difference in height is the main reason for the different trends at higher temperatures and the lack of directionality for the 45 degree sample. The viscous drag mechanism is an interaction between the vapor flow, the microstructure geometry, and the droplet base. At high temperatures, the vapor layer is fully developed and relatively thick. In the case of the 45 degree sample, it is likely that the vapor layer is thick enough to effectively isolate the droplet from the surface microstructures and therefore inhibiting interaction between droplet and surface microstructures, hence no self-propelled motion. Since the 10 degree sample has significantly taller microstructures (see Table 1), this interaction remains intact at high temperatures and thus the propulsion still occurs.

It was also found that the likelihood of a droplet successfully traveling in the desired direction was highly dependent on the surface temperature. Surface temperatures in the range of 250-360° C. resulted in nearly a 100% success rate, meaning that a droplet placed on the surface in this temperature range would remain on the processed area and travel the complete length. At temperatures below this range, the success rate decreased quite rapidly due to droplets exploding or boiling when coming into contact with the surface. At higher temperatures the success rate, once again, also decreased to around 50%. At these higher temperatures the droplet was very sensitive to the transition from the needle to the surface. With a stable vapor layer at these high temperatures and a nearly frictionless state, it was observed that if the droplet had any undesirable momentum from the release it was more likely to travel in an undesirable direction. Because the force acting on the droplet at these high temperatures is fairly small, it is much more difficult to correct the initial droplet direction.

The direction of liquid droplets in the disclosure was found to be opposite to that of ratchet microstructures regardless of surface temperature and structure size. The mechanism used to describe the motion of a Leidenfrost droplet on a ratchet surface can be referred to as the viscous mechanism. This mechanism is based on the preferential direction of vapor flow underneath the droplet. This vapor flow drags the droplet in a direction opposite to the tilt of the ratchet as a result of viscous stresses. This is in contrast to the results of this example. For instance, with regard to a ratchet structure, a structure differing from the FLSP microstructures provided herein, the vapor from an evaporating liquid droplet flows in the direction of descending slope on the teeth of a ratchet (e.g., in an x-direction). When the flow encounters the next ratchet at its vertical surface, the vapor is redirected 90° in the horizontal plane (e.g., y-direction) and flows down the ratchet channels, without an updraft along the vertical surface. Flow in the y-direction is unobstructed; therefore there exists only a net force in the x-direction, which results in the motion of the droplet with the same direction as the vapor flow. This also means that each of the ratchet segments is cellular in the x-direction and develops a similar, yet independent, flow and force. In the instant disclosure, the angled FLSP microstructures are three dimensional and self-organized, thus they result in no channel in the y-direction, unlike with ratchet structures. This difference can contribute to why the direction of droplet motion is different between ratchet structures and FLSP microstructures. As shown schematically in FIG. 8, when vapor is released from a droplet on angled FLSP microstructures, the released vapor can initially follow a profile down the top surface of the microstructure. However because with the angled FLSP microstructures, there is no continuous path in the y-direction, the vapor flowing into the spacing surrounded by neighboring microstructures is forced to be redirected nearly 180°. The redirected vapor drags the droplet through the viscous forces and causes the droplet to move in the opposite direction than with ratchet microstructures.

CONCLUSION

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A microfluidic device, comprising:

a solid structure having a patterned surface, the patterned surface including at least a first patterned region having a first Leidenfrost temperature with respect to a fluid material and a second patterned region having a second Leidenfrost temperature with respect to the fluid material, the first patterned region being adjacent to the second patterned region and forming a Leidenfrost energy barrier between the first patterned region and the second patterned region, the first patterned region defining a path of travel over which a droplet of the fluid material is configured to travel in a Leidenfrost state, and wherein the Leidenfrost energy barrier between the first patterned region and the second patterned region controls or constrains the path of travel to the first patterned region.

2. The microfluidic device of claim 1, wherein the first patterned region includes at least one of a below-surface-growth (BSG) mound pattern, an above-surface-growth (ASG) mound pattern, and a nanostructure-covered pyramid (NC-pyramid) pattern.

3. The microfluidic device of claim 1, wherein the second patterned region includes at least one of a below-surface-growth (BSG) mound pattern, an above-surface-growth (ASG) mound pattern, and a nanostructure-covered pyramid (NC-pyramid) pattern.

4. The microfluidic device of claim 1, wherein the first patterned region includes at least one of a below-surface-growth (BSG) mound pattern, an above-surface-growth (ASG) mound pattern, and a nanostructure-covered pyramid (NC-pyramid) pattern, and the second patterned region includes a different pattern including at least one of a below-surface-growth (BSG) mound pattern, an above-surface-growth (ASG) mound pattern, and a nanostructure-covered pyramid (NC-pyramid) pattern.

5. The microfluidic device of claim 1, wherein the first patterned region includes a plurality of angled microstructures.

6. The microfluidic device of claim 5, wherein the path of travel of the droplet includes a horizontal component that is in a same direction as a horizontal component of an angle from normal to a top surface of a microstructure of the plurality of angled microstructures.

7. The microfluidic device of claim 5, wherein the path of travel of the droplet includes a horizontal component that is in an opposite direction as a horizontal component of vapor flow against a top surface of a microstructure of the plurality of angled microstructures.

8. The microfluidic device of claim 5, wherein at least one of the plurality of angled microstructures is angled between zero degrees and seventy degrees from normal relative to a horizontal plane.

9. A system comprising:

a microfluidic device comprising:

a solid structure having a patterned surface, the patterned surface including at least a first patterned region having a first Leidenfrost temperature with respect to a fluid material and a second patterned region having a second Leidenfrost temperature with respect to the fluid material, the first patterned region being adjacent to the second patterned region and forming a Leidenfrost energy barrier between the first patterned region and the second patterned region, the first patterned region defining a path of travel over which a droplet of the fluid material is configured to travel in a Leidenfrost state and wherein the Leidenfrost energy barrier between the first patterned region and the second patterned region controls or constrains the path of travel to the first patterned region; and a heating element coupled to the first patterned region and the second patterned region, the heating element configured to heat the first patterned region to the first Leidenfrost temperature and to heat the second patterned region to the second Leidenfrost temperature.

10. The system of claim 9, wherein the first patterned region includes at least one of a below-surface-growth (BSG) mound pattern, an above-surface-growth (ASG) mound pattern, and a nanostructure-covered pyramid (NC-pyramid) pattern.

11. The system of claim 9, wherein the second patterned region includes at least one of a below-surface-growth (BSG) mound pattern, an above-surface-growth (ASG) mound pattern, and a nanostructure-covered pyramid (NC-pyramid) pattern.

12. The system of claim 9, wherein the first patterned region includes at least one of a below-surface-growth (BSG) mound pattern, an above-surface-growth (ASG) mound pattern, and a nanostructure-covered pyramid (NC-pyramid) pattern, and the second patterned region includes a different pattern including at least one of a below-surface-growth (BSG) mound pattern, an above-surface-growth (ASG) mound pattern, and a nanostructure-covered pyramid (NC-pyramid) pattern.

13. The system of claim 9, wherein the first patterned region includes a plurality of angled microstructures.

14. The system of claim 13, wherein the path of travel of the droplet includes a horizontal component that is in a same direction as a horizontal component of an angle from normal to a top surface of a microstructure of the plurality of angled microstructures.

15. The system of claim 13, wherein the path of travel of the droplet includes a horizontal component that is in an opposite direction as a horizontal component of vapor flow against a top surface of a microstructure of the plurality of angled microstructures.

16. The system of claim 13, wherein at least one of the plurality of angled microstructures is angled between zero degrees and seventy degrees from normal relative to a horizontal plane.

17. The system of claim 9, wherein the heating element includes a temperature controller configured to control a surface temperature of each of the first patterned region and the second patterned region.

18. The system of claim 17, wherein the temperature controller includes a thermocouple feedback loop.

19. A method comprising:

introducing a liquid droplet to a Leidenfrost microfluidic device, the Leidenfrost microfluidic device including:

a solid structure having a patterned surface, the patterned surface including at least a first patterned region having a first Leidenfrost temperature with respect to a fluid material and a second patterned region having a second Leidenfrost temperature with respect to the fluid material, the first patterned region being adjacent to the second patterned region and forming a Leidenfrost energy barrier between the first patterned region and the second patterned region, the first patterned region defining a path of travel over which a droplet of the fluid material is configured to travel in a Leidenfrost state and wherein the Leidenfrost energy barrier between the first patterned region and the second patterned region controls or constrains the path of travel to the first patterned region;

regulating a temperature of the first patterned region to the first Leidenfrost temperature;

regulating a temperature of the second patterned region to the second Leidenfrost temperature; and propelling the liquid droplet along the path of travel at the Leidenfrost state.

20. The method of claim 19, wherein propelling the liquid droplet along the path at the Leidenfrost state includes maintaining the liquid droplet along the path of travel defined by the first patterned region.

* * * * *